US005295666A

United States Patent [19]

Rollot et al.

[11] Patent Number: 5,295,666

[45] Date of Patent: Mar. 22, 1994

[54] COOLING PLATES FOR BLAST FURNACES AND COOLING INSTALLATION EMPLOYING THIS TYPE OF PLATE

[75] Inventors: Pierre Rollot, Magne; Francois Graffeuille, Dunkerque; Raymond Capelani, deceased, late of Grande-Sytthe, by Christine Capelani, administrator, Alain Dufour, Saint Mitre les Remparts; Hubert Dosda, Saint Martin de Crau; Lucien Delaitre, Donchery; Jean-Michel Dardart, Vrigne Aux Bois; Bernard Thiel, Sedan, all of France

[73] Assignee: Chavane-Ketin, Puteaux, France

[21] Appl. No.: 985,237

[22] Filed: Dec. 2, 1992

Related U.S. Application Data

[63] Continuation of Ser. No. 611,800, Nov. 13, 1990, abandoned.

[30] Foreign Application Priority Data

Nov. 14, 1989 [FR] France ..... 89 14936

[51] Int. Cl.[5] ..... C21B 7/10

[52] U.S. Cl. ..... 266/194; 266/193

[58] Field of Search ..... 266/193, 194, 197

[56] References Cited

U.S. PATENT DOCUMENTS

| | | | |
|---|---|---|---|
| 1,371,906 | 3/1921 | Knox | 266/193 |
| 1,376,617 | 5/1921 | Griggs | 266/193 |
| 3,652,070 | 3/1972 | Sagara | 266/193 |
| 3,892,392 | 7/1975 | Yamada et al. | 266/193 |
| 4,026,352 | 5/1977 | Andoniev et al. | 266/193 |

FOREIGN PATENT DOCUMENTS

| | | | |
|---|---|---|---|
| 0021919 | 1/1981 | European Pat. Off. . | |
| 0337271 | 10/1989 | European Pat. Off. . | |
| 2526928 | 11/1983 | France . | |
| 0496289 | 11/1938 | United Kingdom | 266/193 |

OTHER PUBLICATIONS

Patent Abstracts of Japan vol. 12, No. 248 (C-511) [3095], Jul. 13, 1988 & JP-A-63 35 708 (Nippon Steel Corp.) Feb. 2, 1988.

Soviet Inventions Illustrated, week 84/Jun. 20,27, 1984, Abstract No. 84-125381/20 Derwent Publication Ltd. London GB; & SU-A-590-068 (Ferr, Metal Effl.Purif.) Aug. 15, 1983.

Patent Abstracts of Japan, vol. 14, No. 211 (C-715) [4154] May 2, 1990 & JP-A-02 47 211 (Kawasaki Steel Corp.) Feb. 16, 1990.

*Primary Examiner*—Scott Kastler

*Attorney, Agent, or Firm*—Cushman, Darby & Cushman

[57] ABSTRACT

A cooling plate for a blast furnace is provided including a C-shaped body having two arms which define two continuous horizontal lips being separated by a space, a plurality of inner tubes for carrying a circulating cooling fluid, and a lining element of refractory material disposed in the space. The invention further provides a cooling installation employing the cooling plates

9 Claims, 4 Drawing Sheets

COOLING PLATES FOR BLAST FURNACES AND COOLING INSTALLATION EMPLOYING THIS TYPE OF PLATE

This is a continuation of application No. 07/611,800, filed on Nov. 13, 1990, which was now abandoned.

The present invention relates to a cooling plate used in metallurgical units whose walls are subjected to flows of great heat, such as in the case of blast furnaces, but which can be used for kilns or items of equipment in which it is desired either to capture the flows of heat emitted by the kiln or to heat the walls in a controlled manner with the aid of this same type of plate.

A further subject of the present invention is a cooling installation employing this type of plate.

Modern blast furnaces are increasingly operated at such throughputs and pressure levels that the flows of heat emitted may, globally, locally, and randomly be considerable and it is thus necessary to capture them and transfer them, particularly in the zones of the boshes, body, lower, middle and upper parts of the vessel. In particular, in the case of self-supporting units, it is essential that the casing should not reach temperature levels or should not undergo variations in temperature with the formation of thermomechanical stresses which can adversely affect its behaviour under mechanical stresses.

The flows of heat emitted in the various zones of the blast furnace must be captured by a heterogeneous system formed from the refractory lining of the cooler element, that is to say the cooling plate, of the casing, such that the cooler element fulfils a dual role of energetic cooling of the refractory and as a screen against the passage of the flows towards the casing.

The use of such cooling plates arranged between the inner wall of the casing and the refractory lining is necessary due to the variations in the flows of heat which are inherent to modern blast-furnace operating techniques, it being possible for these variations to be local, rapid and random over time.

In another field of application, the cooling plates may be heated to and maintained at a certain temperature in order to fulfil the functions of heating or of maintaining at temperature bodies of any granulometric form in order to remove their water content or to heat them to a temperature required for their use.

The cooling plates consist of cast-iron elements with a network of tubes running through them, in which a cooling flow, which is generally water, circulates.

These plates are described, in particular in FR-A-2,493,871 and FR-A-2,552,105.

These cooling tubes emerge on a face of the cooling plates and pass through the casing, outside which they are connected either to one another or to cooling tubes of an adjacent upper or lower plate. The tubes thus connected determine circulation lines for the fluid, these lines rising in a substantially vertical plane along the wall of the blast furnace, these lines being connected to an outer circuit for circulating and cooling the fluid.

The cooling plates must be designed such that they provide a satisfactory heat exchange with the cooling fluid and with the refractory lining, while forming a screen against the thermal flow propagating from the furnace towards the casing.

Moreover, they must withstand thermomechanical stresses and deformations resulting from flows of great heat, withstand abrasion when the refractory lining has partially or total disappeared and they must be able to be changed easily without having to penetrate inside the chamber of the blast furnace.

In point of fact, known cooling plates do not always fully meet these conditions.

In fact, they do not make it possible to have available, for certain sensitive zones of the blast furnace, a screen which is even more effective against the passage of the f lows of heat and to irrigate the angular zones of the plates more intensely.

Moreover, they have imperfections which lead to a more or less total and more or less rapid loss of the refractory lining, which results in the plates being placed in contact with the charge of the blast furnace, after only a few years, without having been able to take full advantage of the physics-chemical qualities of the refractories used by substantially postponing the time whereafter the plates are subjected to harsher conditions, the refractory lining having disappeared.

Cooling installations, in particular for blast furnaces, are known, in which the cooling plates consist of a cast-iron element of substantially parallelepipedal form in which longitudinal tubes arranged parallel to one another are embedded, these tubes emerging on the same main face, respectively at the upper part and lower part of the cooling plate, in a protective sleeve, one of the original features of which lies in the corrugated form of the face opposite that from which the cooling tubes emerge.

The cooling plates are fitted with their refractory lining element directly on the metallurgical site during construction or repair of a blast furnace, which prevents this operation being carried out with the required care and quality controls.

The present invention aims to remedy these drawbacks by proposing to provide a cooling installation which is more reliable, and which also acts homogeneously and effectively as a screen against the passage of the flows passing from the furnace towards the casing and enables the refractory lining element to be fitted directly in the workshop.

The subject of the present invention is thus a cooling plate, in particular for a blast furnace, in which a cooling fluid circulates by means of inner tubes and which has the form of a "C" whose arms define two continuous horizontal lips between which is inserted a lining element in refractory material.

According to other features of the invention;

- at least one of the lips comprises an undercut for blocking the lining element in refractory material,
- the lining element in refractory material is composed of shaped refractory bricks,
- the lining element in refractory material is in a single piece, produced by casting a refractory concrete in the space delimited by the lips,
- the brick bearing on the undercut is a brick unblocking all the bricks of the lining element in refractory material,
- the undercut is a notch for retaining the single-piece lining element,
- a lip comprising the undercut is located at the upper part of the cooling plate,
- each lip comprises a horizontal layer of at least one cooling tube as a function of its location in the blast furnace,
- each lip comprises on its hot face an insert of appropriate profile for the reinforcement of said hot face,
- the insert is in silicon carbide.

A further subject of the present invention is a cooling installation, in particular for a blast furnace, with the aid of cooling plates defined herein above, said cooling plates being arranged in successive rings superposed along the inner wall of the casing of the blast furnace and having inner tubes in which a cooling fluid circulates passing through them, the inlets and outlets of the said inner tubes being located at various levels, the inner tubes of two adjacent plates in a vertical plane being connected to one another so as to define a network of vertical circulation lines for the fluid, connected to an outer circuit, wherein the plates of each ring are, relative to the plates of the adjacent ring, offset in a horizontal plane by at least one cooling tube in order to form, over the greater part of the surface of said plates, lines of identical lengths.

BRIEF DESCRIPTION OF THE DRAWINGS

Other features and advantages of the present invention will become apparent during the following description which is given with reference to the appended drawings, in which.

Figure 1:
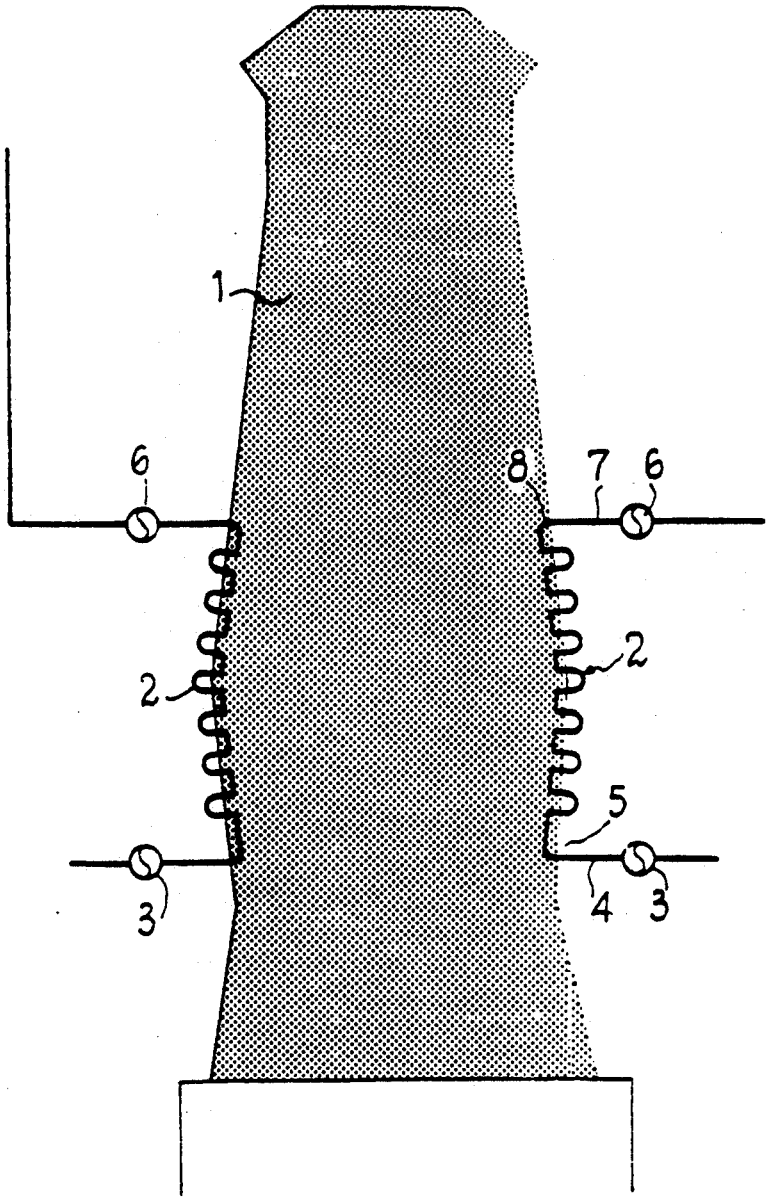
FIG. 1 is a general diagrammatic view of the cooling installation fitted to a blast furnace.

The installation shown in FIG. 1 comprises a blast furnace 1, against the inner wall of which are placed cooling plates, of which only the inner channels have been shown connected to one another, denoted by the general reference 2. The cooling plates in fact comprise inner tubes which emerge at different levels at the upper and lower parts of the latter and are connected to the immediately adjacent upper plate and to the immediately adjacent lower plate in a vertical plane in order to define a circulation line consisting of all the inner tubes connected to one another.

A circular supply channel 3, surrounding the blast furnace at its lower part, comprises an assembly of individual supply channels 4 which are respectively connected to the inlets 5 of the circulation lines 2. A circular return channel 6, surrounding the blast furnace at an upper level, also comprises an assembly of individual return channels 7 connected to the outlets 8 of the circulation lines. This assembly of vertical circulation lines constitutes a network placed along the casing of the blast furnace which is connected respectively at its lower part to the supply bustle pipe 3 and at the upper part to the return bustle pipe 6.

This network of circulation lines is connected at each of its ends by means of feed bustle pipes 3 and return bustle pipes 6 to an outer circuit which is not shown.

FIG. 1, for the purposes of simplification, shows only one feed bustle pipe and one return bustle pipe for a line for circulating cooling fluid.

In fact, the cooling fluid which, in the rest of the description will be considered, in a nonlimiting manner, to be water, is introduced at various levels in the same vertical plane at different rows of cooling plates.

Figure 2:
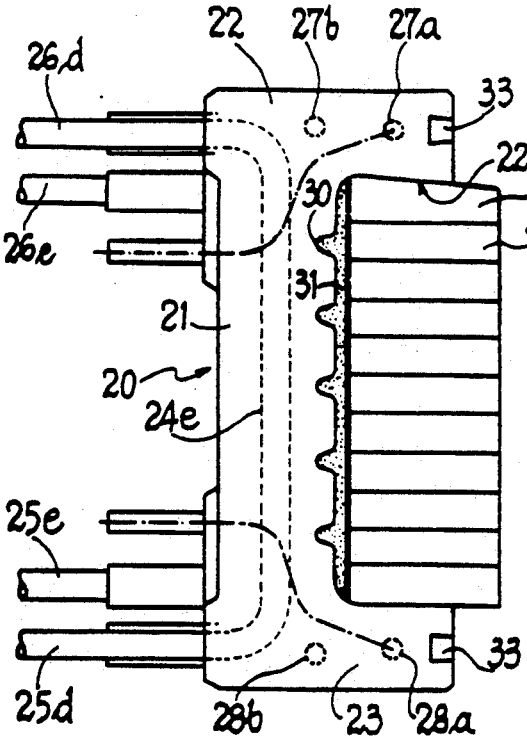
FIG. 2 is a view in lateral elevation of a cooling plate.
Figure 3:
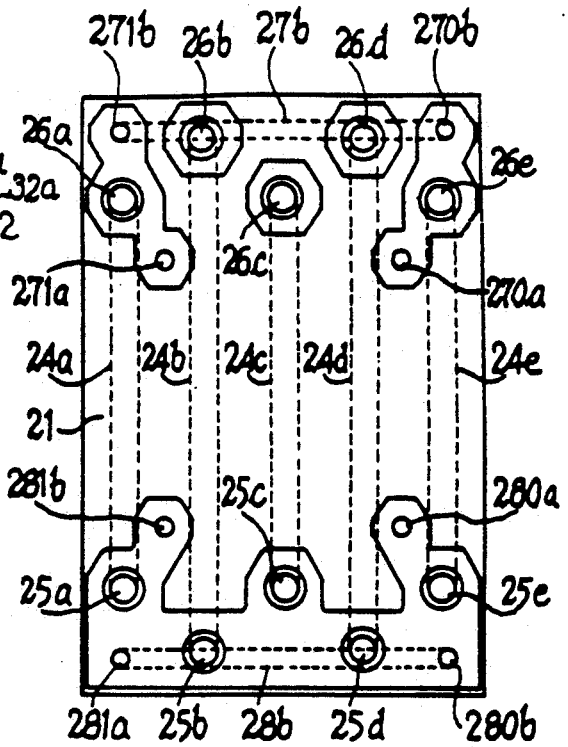
FIG. 3 is a view of the rear face of the cooling plate in FIG. 1.
Figure 4:
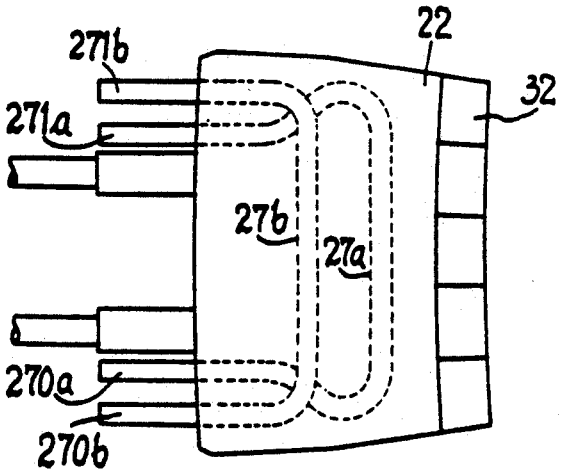
FIG. 4 is a plan view of the cooling plate in FIG. 1.

As shown in FIGS. 2 to 4, each cooling plate 20 consists of a cast-iron element of substantially parallelepipedal form having the form of a "C" whose central part constitutes the body 21 of the plate and whose two arms define at the upper part and at the lower part a continuous and horizontal lip 22 and 23, respectively.

Longitudinal tubes 24*a*, 24*b*, 24*c*..., arranged vertically and parallel to one another are embedded in the body 21 of the plate 20 and, for example, are five in number (FIG. 3).

The inlets 25*a*, 25*b*, 25*c*... and the outlets 26*a*, 26*b*, 26*c* ... of the cooling tubes 24*a*, 24*b*, 24*c*... emerge in the rear face of the plate 20.

The inlets 25*a*, 25*b*, 25*c*... and the outlets 26*a*, 26*b*, 26*c* ... are distributed over three levels in order to define in the body 21 an alternating sequence of short tubes 24*a*, 24*c* and 24*e* and long tubes 24*b* and 24*d*.

Each lip 22 and 23 is cooled, for example, by two transverse tubes 27*a*, 27*b* and 28*a*, 28*b*, respectively, which are arranged horizontally and the inlets 270*a*, 270*b* and 280*a*, 280*b* and the outlets 271*a*, 271*b* and 281*a*, 281*b* of which emerge in the rear face of the cooling plate.

The horizontal tubes 25*a*, 27*b* and 28*a* and 28*b* make it possible to cool the corners of the cooling plate 20 more intensely and, together with the longitudinal tubes homogeneously act as a screen against the passage of the flows of heat by efficient cooling of each of the cooling plates 20 and of the assembly of plates which are adjacent to them.

The number of horizontal tubes depends on the position of the cooling plate 20 in the blast furnace.

The cross section of the horizontal tubes 27*a*, 27*b*, 28*a* and 28*b* is such that with sufficient circulation speeds, greater than 2m/s, it is possible to capture the flows emitted without requiring considerable flow rates nor creating abnormally large losses of charge.

The speed of circulation of the cooling fluid in the vertical tubes 24*a*, 24*b*, 24*c* ... may be adjusted as a function of a cooling module.

The front face of the plate 20 located between the lips 22 and 23 comprises a corrugation 30 (FIG. 2), the undulations of which are filled with a refractory product 31 which is a good conductor and is of small particle size.

The thickness of the lips 22 and 23 is of the order of 200 mm. At least one of the lips, for example the lip 22 in the example shown in FIG. 2, comprises an undercut 22*a* which makes it possible to block, for example, the bricks 32 made especially from nitride-bonded silicon carbide and which form the refractory lining.

The brick 32*a* bearing on the undercut 22*a* is a wedge brick blocking the assembly of refractory bricks.

By virtue of the "C", form of the cooling plate 20, the bricks 32 may be mounted directly in the workshop when the plates are manufactured with all the required care and quality controls which cannot be applied in full during the customary period for the construction or repair of the refractory walls of the blast furnaces on the metallurgical site.

The refractory lining element may be in a single piece, for example in refractory concrete cast between the lips 22 and 23 and, in this case, the undercut 22*a* forms a notch for holding said element on the plate 20.

Thus, this new generation of cooling plates makes it possible to obtain a better contact between the cast iron and the refractory, quality assurance when employing refractories and a time saving during the operations of constructing or repairing blast furnaces.

Each lip 22 and 23 comprises, on its hot face, an insert 33, for example in silicon carbide, particularly with a dovetail trapezoidal cross section, for reinforcing said hot lace (FIG. 2).

Figure 5:
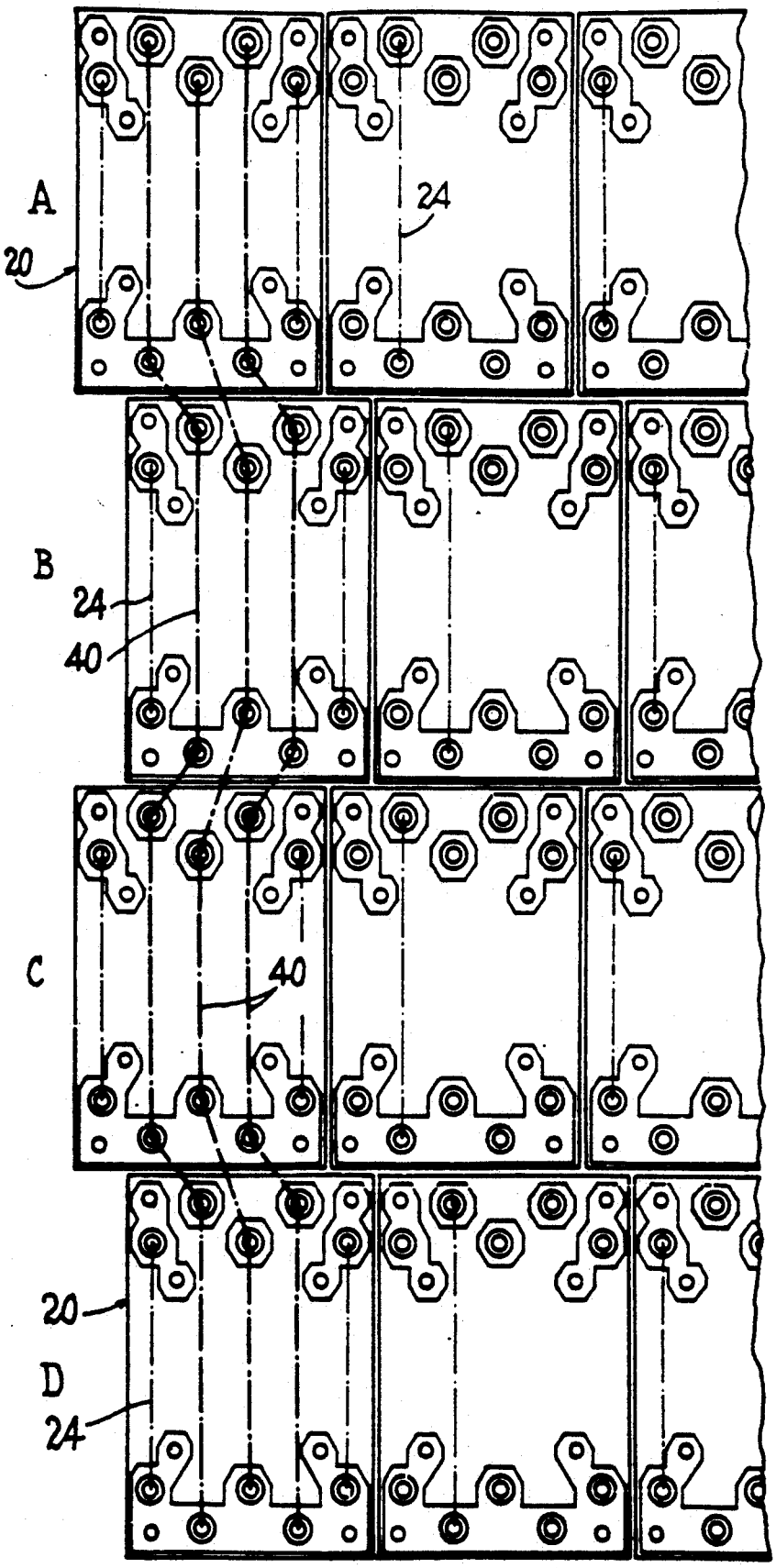
FIG. 5 is a partial, developed view of the network of lines for circulating the cooling fluid over a part of the total circumference of the blast furnace.

If reference is made to FIG. 5, it will be observed that the cooling plates 20 are arranged in successive rings A, B, C ... superposed along the inner wall of the casing of the blast furnace and the inner tubes 24 of two adjacent plates in a vertical plane are connected to one another in order to define a network of vertical circulation lines for the fluid, connected to the outer circuit.

As may be seen in FIG. 5, the plates 20 of every other ring, for example the plates 20 of the rings B and D, are offset in a horizontal plane relative to the plates 20 of the adjacent upper ring A and C of a tube for the circulation of the cooling fluid so as to form, over the greater part of the surface determined by said cooling plates, lines 40 of identical lengths.

Figure 6:
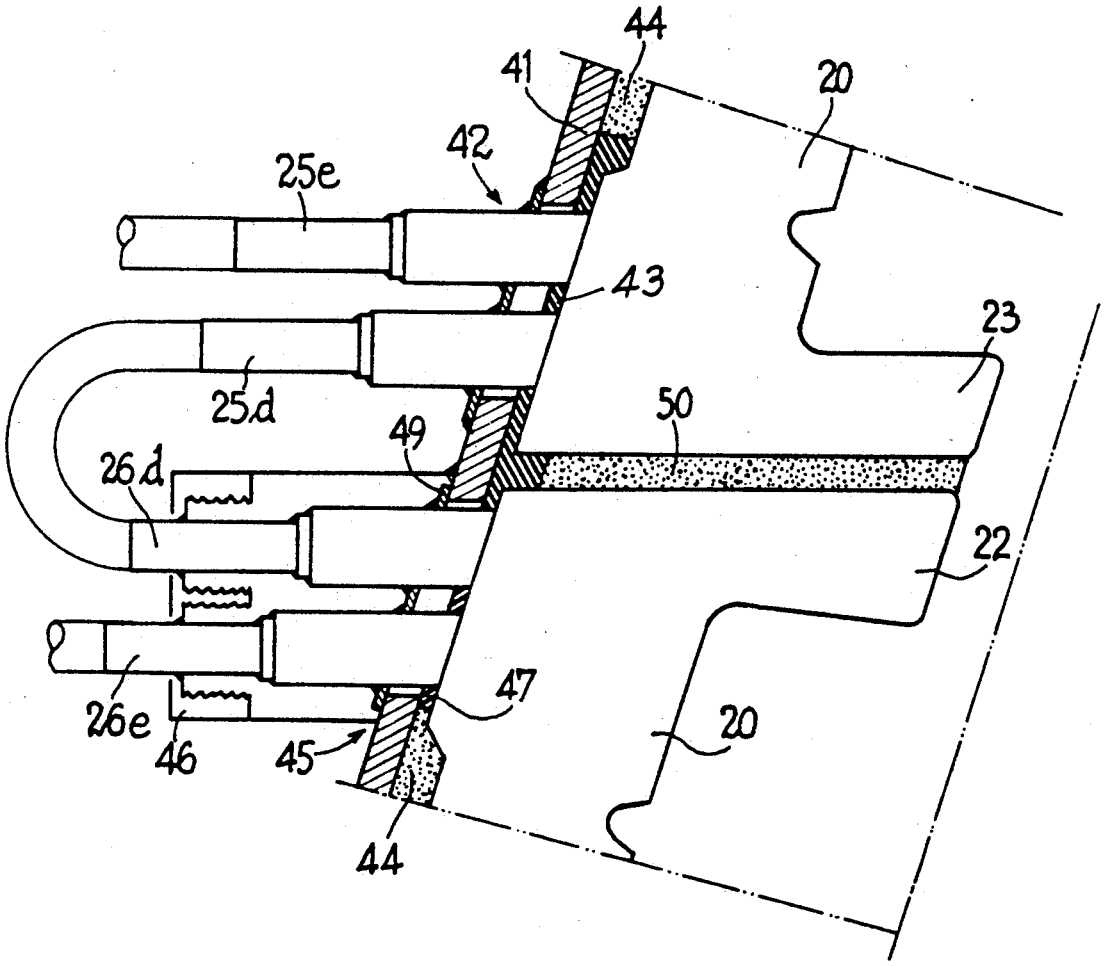
FIG. 6 is a partial view in lateral elevation showing the fixing of two cooling plates on the casing of the blast furnace.

This definition makes it possible to obtain a uniform distribution of the cooling fluid.

with reference, now, to FIG. 6, a description will be given of the fixing of the plates 20 on the casing 41 of the blast furnace.

Each plate 20 is fixed on the casing 41 with the aid, on the one hand, of a fixed point 42, for example, in the lower part with a controlled pressure on continuous elastomer joints 43 and insulating packing materials 44 and, on the other hand, of a movable point 45 with sealing compensators 46, for example, at the upper part of the said plate 20 with controlled pressure on the discontinuous elastomer joints 47 and insulating packing materials 44.

Welded washers 48 are provided between the inlets 25 of the tubes 24 and the casing 41 at the level of the fixed points 42, while sliding washers 49 are provided between the outlets 26 of the tubes 24 at the level of the movable points 45.

These devices permit relative movement between the plates 20 and the eventual changing of the latter at the end of the blast furnace campaign in a very short time without having to penetrate inside the blast furnace.

Between two adjacent cooling plates 20 are provided joints 50 which are mounted after positioning of said plates on the casing 41. These joints 50 consist, for example, of a fibrous mastic.

The installation according to the present invention makes it possible to have available, for certain sensitive zones of the blast furnace a screen which is even more effective against the passage of the flow of heat, to irrigate the angular zones of the plates more intensely and to avoid the creation of more or less great interfaces which are prejudicial to the transfer of heat and phenomenon of conduction via the assembly formed by the plates and the refractory wall.

Moreover, the particular form of the cooling plates prevents detachment of the refractory lining from its support on the hot face, which makes it possible to take full advantage of the physics-chemical qualities of the refractories.

We claim:

1. A cooling installation for a blast furnace comprising:

cooling plates, said cooling plates being arranged between an inner wall of a casing and a refractory lining in successive rings superimposed along the inner wall of a casing of the blast furnace and having inner tubes in which a a cooling fluid circulates therethrough, inlets and outlets of said inner tubes being located at various levels, the inner tubes of two adjacent plates in a vertical plane being connected to one another in order to create a network of substantially vertical circulation lines for the fluid, connected to an outer circuit, said inner tubes emerging at a face of the cooling plates and passing through the casing, each cooling plate having the form of a "C" whose arms define two continuous horizontal lips between which is inserted a lining element of refractory material, at least one of the lips comprising an undercut for blocking the lining element of refractory material.

2. The installation as claimed in claim 1, wherein each cooling plate is fixed with controlled pressure against the casing of the blast furnace with the aid of (1) fixed points in the lower part or upper part of said plate on continuous elastomer joints and insulating packing materials and (2) of movable points with a sealing compensator at the upper part or at the lower part of said plate on discontinuous elastomer joints and insulating packing materials.

3. The installation as claimed in claim 1, wherein the lining element of refractory material is composed of shaped refractory bricks.

4. The installation as claimed in claim 1, wherein the lining element of refractory material is in a single piece produced by casting a refractory concrete in the space delimited by the lips.

5. The installation as claimed in claim 3, wherein the brick bearing on the undercut is a wedge brick blocking the assembly of bricks of the lining element of refractory material.

6. The installation as claimed in claim 1, wherein the undercut is a notch for holding the single piece lining element.

7. The installation as claimed in claim 1, wherein a lip comprising the undercut is located at the upper part of said cooling plate.

8. The installation as claimed in claim 1, wherein each lip comprises a horizontal layer of at least one cooling tube as a function of its location in the blast furnace.

9. The installation as claimed in claim 1, wherein each lip comprises on its hot face an insert of appropriate profile for the reinforcement of said hot face.

* * * * *